US007209152B2

(12) United States Patent
Chiaki et al.

(10) Patent No.: US 7,209,152 B2
(45) Date of Patent: Apr. 24, 2007

(54) SIGNAL PROCESSOR FOR MULTIPLE GRADATIONS

(75) Inventors: Yutaka Chiaki, Kawasaki (JP); Shunji Ohta, Kawasaki (JP); Masanori Takeuchi, Kawasaki (JP); Masaya Tajima, Kawasaki (JP); Akira Yamamoto, Kawasaki (JP); Yuichiro Kimura, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 632 days.

(21) Appl. No.: 10/800,776

(22) Filed: Mar. 16, 2004

(65) Prior Publication Data

US 2004/0263539 A1 Dec. 30, 2004

(30) Foreign Application Priority Data

Jun. 30, 2003 (JP) ..... 2003-187894

(51) Int. Cl.
*G09G 5/00* (2006.01)
*G09G 5/02* (2006.01)
*G09G 3/28* (2006.01)

(52) U.S. Cl. ..... 345/692; 345/690; 345/691; 345/693; 345/694; 345/60; 345/63; 345/68; 345/72

(58) Field of Classification Search ..... 345/60, 345/63, 68, 72, 204, 690, 691, 692, 693, 345/694, 696
See application file for complete search history.

(56) References Cited

U.S. PATENT DOCUMENTS

| | | | | |
|---|---|---|---|---|
| 5,898,414 | A * | 4/1999 | Awamoto et al. | 345/55 |
| 6,104,362 | A * | 8/2000 | Kuriyama et al. | 345/63 |
| 6,144,364 | A * | 11/2000 | Otobe et al. | 345/691 |
| 6,249,265 | B1 * | 6/2001 | Tajima et al. | 345/63 |
| 6,924,778 | B2 * | 8/2005 | Awamoto et al. | 345/60 |
| 2002/0190925 | A1 | 12/2002 | Awamoto et al. | |

FOREIGN PATENT DOCUMENTS

| | | |
|---|---|---|
| JP | 7-271325 | 10/1995 |
| JP | 10-31455 | 2/1998 |
| JP | 2002-372948 | 12/2002 |

* cited by examiner

*Primary Examiner*—Richard Hjerpe
*Assistant Examiner*—My-Chau T. Tran
(74) *Attorney, Agent, or Firm*—Staas & Halsey LLP

(57) ABSTRACT

A signal processor for multiple gradations for carrying out coding by replacing an input image signal with a plurality of subfields, comprising a main path for generating a primary color signal having a first number of gradations, a sub-path for generating a primary color signal having a second number of gradations, which is smaller than the first number of gradations, a switch, a movement detection circuit, a level detection circuit, a path switching control circuit for switching the switch based on the amount of movement and the level, plural subfield coding circuits for carrying out subfield coding different from each another, a superposing circuit for selecting one of the outputs of the plural subfield coding circuits, and a superposing control circuit, and thus preventing a moving false contour.

16 Claims, 14 Drawing Sheets

FIG. 4A

GRADATION LUMINANCE RATIO

| SF | 1 | 2 | 3 | 4 | 5 | 6 | 7 | 8 |
|---|---|---|---|---|---|---|---|---|
| | 16 | 8 | 4 | 1 | 2 | 8 | 8 | 16 |
| 0 | | | | | | | | |
| 1 | | | | ○ | | | | |
| 2 | | | | | ○ | | | |
| 3 | | | | ○ | ○ | | | |
| 4 | | | ○ | | | | | |
| 5 | | | ○ | ○ | | | | |
| 6 | | | ○ | | ○ | | | |
| 7 | | | ○ | ○ | ○ | | | |
| 8 | | ○ | | | | | | |
| 9 | | ○ | | ○ | | | | |
| 10 | | ○ | | | ○ | | | |
| 11 | | ○ | | ○ | ○ | | | |
| 12 | | ○ | ○ | | | | | |
| 13 | | ○ | ○ | ○ | | | | |
| 14 | | ○ | ○ | | ○ | | | |
| 15 | | ○ | ○ | ○ | ○ | | | |
| 16 | | ○ | | | | ○ | | |
| 17 | | ○ | | ○ | | ○ | | |
| 18 | | ○ | | | ○ | ○ | | |
| 19 | | ○ | | ○ | ○ | ○ | | |
| 20 | | ○ | ○ | | | ○ | | |
| 21 | | ○ | ○ | ○ | | ○ | | |
| 22 | | ○ | ○ | | ○ | ○ | | |
| 23 | | ○ | ○ | ○ | ○ | ○ | | |
| 24 | | ○ | | | | ○ | ○ | |
| 25 | | ○ | | ○ | | ○ | ○ | |
| 26 | | ○ | | | ○ | ○ | ○ | |
| 27 | | ○ | | ○ | ○ | ○ | ○ | |
| 28 | | ○ | ○ | | | ○ | ○ | |
| 29 | | ○ | ○ | ○ | | ○ | ○ | |
| 30 | | ○ | ○ | | ○ | ○ | ○ | |
| 31 | | ○ | ○ | ○ | ○ | ○ | ○ | |

FIG. 4B

GRADATION LUMINANCE RATIO

| SF | 1 | 2 | 3 | 4 | 5 | 6 | 7 | 8 | L |
|---|---|---|---|---|---|---|---|---|---|
| | 16 | 8 | 8 | 2 | 1 | 4 | 8 | 16 | |
| 0 | | | | | | | | | 0 |
| 1 | | | | | ○ | | | | 0 |
| 2 | | | | ○ | | | | | 0 |
| 3 | | | | ○ | ○ | | | | 0 |
| 4 | | | | | | ○ | | | 2 |
| 5 | | | | | ○ | ○ | | | 0 |
| 6 | | | | ○ | | ○ | | | 0 |
| 7 | | | | ○ | ○ | ○ | | | 0 |
| 8 | | | | | | | ○ | | 3 |
| 9 | | | | | ○ | | ○ | | 0 |
| 10 | | | | ○ | | | ○ | | 0 |
| 11 | | | | ○ | ○ | | ○ | | 0 |
| 12 | | | | | | ○ | ○ | | 2 |
| 13 | | | | | ○ | ○ | ○ | | 0 |
| 14 | | | | ○ | | ○ | ○ | | 0 |
| 15 | | | | ○ | ○ | ○ | ○ | | 0 |
| 16 | | | ○ | | | | ○ | | 3 |
| 17 | | | ○ | | ○ | | ○ | | 0 |
| 18 | | | ○ | ○ | | | ○ | | 0 |
| 19 | | | ○ | ○ | ○ | | ○ | | 0 |
| 20 | | | ○ | | | ○ | ○ | | 2 |
| 21 | | | ○ | | ○ | ○ | ○ | | 0 |
| 22 | | | ○ | ○ | | ○ | ○ | | 0 |
| 23 | | | ○ | ○ | ○ | ○ | ○ | | 0 |
| 24 | | ○ | ○ | | | | ○ | | 3 |
| 25 | | ○ | ○ | | ○ | | ○ | | 0 |
| 26 | | ○ | ○ | ○ | | | ○ | | 0 |
| 27 | | ○ | ○ | ○ | ○ | | ○ | | 0 |
| 28 | | ○ | ○ | | | ○ | ○ | | 2 |
| 29 | | ○ | ○ | | ○ | ○ | ○ | | 0 |
| 30 | | ○ | ○ | ○ | | ○ | ○ | | 0 |
| 31 | | ○ | ○ | ○ | ○ | ○ | ○ | | 0 |

FIG. 5A

GRADATION LUMINANCE RATIO

| SF | 1 | 2 | 3 | 4 | 5 | 6 | 7 | 8 |
|---|---|---|---|---|---|---|---|---|
| | 16 | 8 | 4 | 1 | 2 | 8 | 8 | 16 |
| 32 | ○ | ○ | | | | | ○ | |
| 33 | ○ | ○ | | ○ | | | ○ | |
| 34 | ○ | ○ | | | ○ | | ○ | |
| 35 | ○ | ○ | | ○ | ○ | | ○ | |
| 36 | ○ | ○ | ○ | | | | ○ | |
| 37 | ○ | ○ | ○ | ○ | | | ○ | |
| 38 | ○ | ○ | ○ | | ○ | | ○ | |
| 39 | ○ | ○ | ○ | ○ | ○ | | ○ | |
| 40 | ○ | ○ | | | | ○ | ○ | |
| 41 | ○ | ○ | | ○ | | ○ | ○ | |
| 42 | ○ | ○ | | | ○ | ○ | ○ | |
| 43 | ○ | ○ | | ○ | ○ | ○ | ○ | |
| 44 | ○ | ○ | ○ | | | ○ | ○ | |
| 45 | ○ | ○ | ○ | ○ | | ○ | ○ | |
| 46 | ○ | ○ | ○ | | ○ | ○ | ○ | |
| 47 | ○ | ○ | ○ | ○ | ○ | ○ | ○ | |
| 48 | ○ | ○ | | | | ○ | | ○ |
| 49 | ○ | ○ | | ○ | | ○ | | ○ |
| 50 | ○ | ○ | | | ○ | ○ | | ○ |
| 51 | ○ | ○ | | ○ | ○ | ○ | | ○ |
| 52 | ○ | ○ | ○ | | | ○ | | ○ |
| 53 | ○ | ○ | ○ | ○ | | ○ | | ○ |
| 54 | ○ | ○ | ○ | | ○ | ○ | | ○ |
| 55 | ○ | ○ | ○ | ○ | ○ | ○ | | ○ |
| 56 | ○ | ○ | | | | ○ | ○ | ○ |
| 57 | ○ | ○ | | ○ | | ○ | ○ | ○ |
| 58 | ○ | ○ | | | ○ | ○ | ○ | ○ |
| 59 | ○ | ○ | | ○ | ○ | ○ | ○ | ○ |
| 60 | ○ | ○ | ○ | | | ○ | ○ | ○ |
| 61 | ○ | ○ | ○ | ○ | | ○ | ○ | ○ |
| 62 | ○ | ○ | ○ | | ○ | ○ | ○ | ○ |
| 63 | ○ | ○ | ○ | ○ | ○ | ○ | ○ | ○ |

FIG. 5B

GRADATION LUMINANCE RATIO

| SF | 1 | 2 | 3 | 4 | 5 | 6 | 7 | 8 | L |
|---|---|---|---|---|---|---|---|---|---|
| | 16 | 8 | 4 | 1 | 2 | 8 | 8 | 16 | |
| 32 | | ○ | | | | | ○ | ○ | 4 |
| 33 | | ○ | | | ○ | | ○ | ○ | 0 |
| 34 | | ○ | | ○ | | | ○ | ○ | 0 |
| 35 | | ○ | | ○ | ○ | | ○ | ○ | 0 |
| 36 | | ○ | | | | ○ | ○ | ○ | 2 |
| 37 | | ○ | | | ○ | ○ | ○ | ○ | 0 |
| 38 | | ○ | | ○ | | ○ | ○ | ○ | 0 |
| 39 | | ○ | | ○ | ○ | ○ | ○ | ○ | 0 |
| 40 | | ○ | ○ | | | | ○ | ○ | 3 |
| 41 | | ○ | ○ | | ○ | | ○ | ○ | 0 |
| 42 | | ○ | ○ | ○ | | | ○ | ○ | 0 |
| 43 | | ○ | ○ | ○ | ○ | | ○ | ○ | 0 |
| 44 | | ○ | ○ | | | ○ | ○ | ○ | 2 |
| 45 | | ○ | ○ | | ○ | ○ | ○ | ○ | 0 |
| 46 | | ○ | ○ | ○ | | ○ | ○ | ○ | 0 |
| 47 | | ○ | ○ | ○ | ○ | ○ | ○ | ○ | 0 |
| 48 | ○ | | ○ | | | | ○ | ○ | 4 |
| 49 | ○ | | ○ | | ○ | | ○ | ○ | 0 |
| 50 | ○ | | ○ | ○ | | | ○ | ○ | 0 |
| 51 | ○ | | ○ | ○ | ○ | | ○ | ○ | 0 |
| 52 | ○ | | ○ | | | ○ | ○ | ○ | 2 |
| 53 | ○ | | ○ | | ○ | ○ | ○ | ○ | 0 |
| 54 | ○ | | ○ | ○ | | ○ | ○ | ○ | 0 |
| 55 | ○ | | ○ | ○ | ○ | ○ | ○ | ○ | 0 |
| 56 | ○ | ○ | ○ | | | | ○ | ○ | 3 |
| 57 | ○ | ○ | ○ | | ○ | | ○ | ○ | 0 |
| 58 | ○ | ○ | ○ | ○ | | | ○ | ○ | 0 |
| 59 | ○ | ○ | ○ | ○ | ○ | | ○ | ○ | 0 |
| 60 | ○ | ○ | ○ | | | ○ | ○ | ○ | 2 |
| 61 | ○ | ○ | ○ | | ○ | ○ | ○ | ○ | 0 |
| 62 | ○ | ○ | ○ | ○ | | ○ | ○ | ○ | 0 |
| 63 | ○ | ○ | ○ | ○ | ○ | ○ | ○ | ○ | 0 |

FIG. 6A

| PIXEL | d | d+1 | d+2 | d+3 | d+4 | d+5 |
|---|---|---|---|---|---|---|
| LINE l | A | A | A | A | A | A |
| l+1 | B | B | B | B | B | B |
| l+2 | A | A | A | A | A | A |
| l+3 | B | B | B | B | B | B |

FIG. 6B

| PIXEL | d | d+1 | d+2 | d+3 | d+4 | d+5 |
|---|---|---|---|---|---|---|
| LINE l | A | A | A | A | A | A |
| l+1 | B | B | B | B | B | B |
| l+2 | A | A | A | A | A | A |
| l+3 | B | B | B | B | B | B |

FIELD n

| d | d+1 | d+2 | d+3 | d+4 | d+5 |
|---|---|---|---|---|---|
| B | B | B | B | B | B |
| A | A | A | A | A | A |
| B | B | B | B | B | B |
| A | A | A | A | A | A |

FIELD n+1

FIG. 8A

| PIXEL | d | d+1 | d+2 | d+3 | d+4 | d+5 |
|---|---|---|---|---|---|---|
| LINE l | A | B | A | B | A | B |
| l+1 | A | B | A | B | A | B |
| l+2 | A | B | A | B | A | B |
| l+3 | A | B | A | B | A | B |

FIG. 8B

| PIXEL | d | d+1 | d+2 | d+3 | d+4 | d+5 |
|---|---|---|---|---|---|---|
| LINE l | A | B | A | B | A | B |
| l+1 | A | B | A | B | A | B |
| l+2 | A | B | A | B | A | B |
| l+3 | A | B | A | B | A | B |

FIELD n

| d | d+1 | d+2 | d+3 | d+4 | d+5 |
|---|---|---|---|---|---|
| B | A | B | A | B | A |
| B | A | B | A | B | A |
| B | A | B | A | B | A |
| B | A | B | A | B | A |

FIELD n+1

FIG. 9A

| PIXEL | d | d+1 | d+2 | d+3 | d+4 | d+5 |
|---|---|---|---|---|---|---|
| LINE l | A | B | A | B | A | B |
| l+1 | B | A | B | A | B | A |
| l+2 | A | B | A | B | A | B |
| l+3 | B | A | B | A | B | A |

FIG. 9B

| PIXEL | d | d+1 | d+2 | d+3 | d+4 | d+5 |
|---|---|---|---|---|---|---|
| LINE l | A | B | A | B | A | B |
| l+1 | B | A | B | A | B | A |
| l+2 | A | B | A | B | A | B |
| l+3 | B | A | B | A | B | A |

FIELD n

| d | d+1 | d+2 | d+3 | d+4 | d+5 |
|---|---|---|---|---|---|
| B | A | B | A | B | A |
| A | B | A | B | A | B |
| B | A | B | A | B | A |
| A | B | A | B | A | B |

FIELD n+1

FIG.10A

FIELD f

| | PIXEL d | | | d+1 | | | d+2 | | | d+3 | | | d+4 | | | d+5 | | |
|---|---|---|---|---|---|---|---|---|---|---|---|---|---|---|---|---|---|---|
| | R | G | B | R | G | B | R | G | B | R | G | B | R | G | B | R | G | B |
| LINE l | α | α | β | β | α | α | β | β | α | α | β | β | α | α | β | β | α | α |
| LINE l+1 | α | β | β | α | α | β | β | α | α | β | β | α | α | β | β | α | α | β |
| LINE l+2 | β | β | α | α | β | β | α | α | β | β | α | α | β | β | α | α | β | β |
| LINE l+3 | β | α | α | β | β | α | α | β | β | α | α | β | β | α | α | β | β | α |
| LINE l+4 | α | α | β | β | α | α | β | β | α | α | β | β | α | α | β | β | α | α |

FIG.10B

FIELD f+1

| | PIXEL d | | | d+1 | | | d+2 | | | d+3 | | | d+4 | | | d+5 | | |
|---|---|---|---|---|---|---|---|---|---|---|---|---|---|---|---|---|---|---|
| | R | G | B | R | G | B | R | G | B | R | G | B | R | G | B | R | G | B |
| LINE l | α | β | β | α | α | β | β | α | α | β | β | α | α | β | β | α | α | β |
| LINE l+1 | β | β | α | α | β | β | α | α | β | β | α | α | β | β | α | α | β | β |
| LINE l+2 | β | α | α | β | β | α | α | β | β | α | α | β | β | α | α | β | β | α |
| LINE l+3 | α | α | β | β | α | α | β | β | α | α | β | β | α | α | β | β | α | α |
| LINE l+4 | α | β | β | α | α | β | β | α | α | β | β | α | α | β | β | α | α | β |

FIG.10C

FIELD f+2

| | PIXEL d | | | d+1 | | | d+2 | | | d+3 | | | d+4 | | | d+5 | | |
|---|---|---|---|---|---|---|---|---|---|---|---|---|---|---|---|---|---|---|
| | R | G | B | R | G | B | R | G | B | R | G | B | R | G | B | R | G | B |
| LINE l | β | β | α | α | β | β | α | α | β | β | α | α | β | β | α | α | β | β |
| LINE l+1 | β | α | α | β | β | α | α | β | β | α | α | β | β | α | α | β | β | α |
| LINE l+2 | α | α | β | β | α | α | β | β | α | α | β | β | α | α | β | β | α | α |
| LINE l+3 | α | β | β | α | α | β | β | α | α | β | β | α | α | β | β | α | α | β |
| LINE l+4 | β | β | α | α | β | β | α | α | β | β | α | α | β | β | α | α | β | β |

SIGNAL PROCESSOR FOR MULTIPLE GRADATIONS

BACKGROUND OF THE INVENTION

The present invention relates to a signal processor for multiple gradations for processing an image signal, in order to attain a display with multiple gradations by making up one field of a plurality of subfields weighted with a predetermined luminance and bringing each display cell into a lit or unlit state on a subfield basis, when a display device, such as a PDP panel, EL panel, and some LCD panels, capable of only controlling the lit or unlit state, is used.

In the case of a display device, such as a PDP panel, an EL panel and some LCD panels using a display element which cannot change the intensity of display of each cell arbitrarily, a display with multiple gradations is attained by making up one field of a plurality of subfields weighted with a predetermined luminance and bringing each display cell into a lit or unlit state on a subfield basis.

Conventionally, when a display with multiple gradations is attained by means of the subfield configuration, it is most general that the ratio of luminance among subfields is set to, for example, 1:2:4:8, each term being a power of two. By setting a luminance ratio in such a relation, a display with gradation can be attained most efficiently.

As to a display with multiple gradations using a subfield configuration, there arises the problem that a false contour is caused to occur in the case of a moving image because the lit-state periods are discrete in a field period. In order to solve such a problem, various possible solutions have been proposed heretofore. For example, as to the configuration having the above-mentioned luminance ratio, a method has been proposed in which a subfield with a heavy weight are arranged in the center of a field. With this configuration, however, a moving false contour is caused to occur in an image with relatively small luminance and the image quality is not good enough.

Japanese Unexamined Patent Publication (Kokai) No. 7-271325 has disclosed a superposing method, in which, although the display efficiency is degraded more or less, subfields with the same luminance ratio are provided in one field and plural subfield coding tables for representing the same luminance by a combination of different subfields are prepared and, when a subfield configuration for each pixel is determined, different subfield coding tables are used for each vertical or horizontal display line or each pixel, or for each subfield so that the occurrence of a moving false contour can be prevented.

However, when the superposing method is used, there arises a problem: noise with a checkerboard pattern is produced. Therefore, Japanese Unexamined Patent Publication (Kokai) No. 2002-372948 has proposed a superposing method, in which a moving image and a specific gradation are detected, and the superposing method is used only in a case where that the image is a moving image is detected and that the gradation is likely to produce a moving false contour is detected, and in other cases, one subfield coding table is used.

On the other hand, Japanese Unexamined Patent Publication (Kokai) No. 10-31455 has disclosed a path switching method for preventing the generation of a moving false contour by switching between a sub-path, in which only a gradation whose number of subfields to be lit is increased by one can be displayed and a subfield arrangement in which subfields to be lit are arranged successively is used, and a main path, in which any combination of gradations in such a subfield arrangement can be selected, so that the main path is selected normally for carrying out the process for multiple gradations and the sub-path is selected only in a case where that the image is a moving image is detected and that the gradation is likely to produce a moving false contour is detected. In the path switching method, there exists a difference between the main path and the sub-path in the number of gradations that can be displayed, therefore, the gain adjustment or error diffusion process for an image signal is carried out.

As the superposing method and the path switching method are described in detail in the above-mentioned documents, an explanation will not be given here.

SUMMARY OF THE INVENTION

According to the superposing method, in which a moving image and a specific gradation are detected, as disclosed in Japanese Unexamined Patent Publication (Kokai) No. 2002-372948, there arises a problem: noise with a checkerboard pattern can be reduced but the occurrence of a moving false contour cannot be prevented sufficiently in the case of a fast moving image. This is because the occurrence of a moving false contour can be prevented between neighboring pixels by the superposing method but when a false contour occurs across plural pixels such as in a case of a fast moving image, a sufficient effect cannot be obtained.

On the other hand, by the use of the path switching method disclosed in Japanese Unexamined Patent Publication (Kokai) No. 10-31455, a moving false contour can be prevented by switching to the sub-path but there arises a problem that a sense of discontinuity is produced from the image because noise due to the error diffusion process becomes conspicuous and the shock of the switching between the sub-path and the main path (granular noise due to the error diffusion by the sub-path in contrast to the smooth representation with gradation by the main path), regardless of the moving speed when the image is a moving image and the area of the moving image is large.

As described above, the superposing method, in which a moving image and a specific gradation are detected, and the path switching method each have a problem: the moving false contour cannot be prevented sufficiently depending on images.

The object of the present invention is to realize a signal processor for multiple gradations for obtaining an excellent image quality by further preventing the moving false contour.

In order to realize the above-mentioned object, the present invention realizes a new signal processor for multiple gradations by merging the superposing method, in which a moving image and a specific gradation are detected, and the path switching method.

In other words, the signal processor for multiple gradations according to the present invention is one in which one field of an input image signal having a predetermined number of gradations is replaced, for each primary color signal, with plural subfields weighted with luminance and each display cell is coded into a lit or unlit state on a subfield basis, the signal processor being characterized by comprising: a main path for generating a primary color signal with a first number of gradations, the first number of gradations being equal to or smaller than the predetermined number of gradations, from the primary color signal of the input image signal having the predetermined number of gradations; a sub-path for generating a primary color signal with a second number of gradations, the second number of gradations being smaller than the first number of gradations; a switch for switching so that either of the signal generated by the main path and the signal generated by the sub-path is output; a movement detection circuit for detecting the moving area and the amount of movement by detecting the change in primary color signal between the current field of the input image signal and its predecessor on a pixel basis; a level detection circuit for detecting the amount of level indicating the tendency for the moving image false contour to appear for each primary color signal of the main path on a pixel basis; a path switching control circuit for judging the selection of the sub-path for preventing the false contour from occurring for each pixel of each primary color signal based on the detected amount of movement and amount of level and switching the switch from the main path output to the sub-path output based on the sub-path selection judgment result; plural subfield coding circuits to which the signal output from the switch is input and for outputting a converted signal by carrying out subfield coding different from each other; a superposing circuit to which the output from the plural subfield coding circuits is input and for selecting one of the input signals; and a superposing control circuit for controlling the selection of the output of the plural subfield coding circuits in the superposing circuit for each pixel of each primary color signal.

The moving image false contour may appear for every gradation where carrying (borrowing) takes place in the subfield configuration and is more conspicuous for a gradation where carrying to a subfield with a heavier weight takes place. In other words, the moving image false contour is not conspicuous, even if it appears, and can be ignored for a gradation where carrying to a subfield with a lighter weight takes place. In the present invention, the level at which the false contour is conspicuous, that is, the tendency of the moving image false contour to appear, is represented by the amount of level L when the occurrence of the moving image false contour is detected, and the amount of level L is set for each gradation.

It may be possible for the superposing process to be carried out at all times but it may also be possible to do so only when the detected amount of movement is equal to or larger than a first amount of movement, that is, only in the case of a moving image, for each pixel of each primary color signal. When the superposing process is carried out, the selection of the plural subfield coding circuits in the superposing circuit is changed sequentially and when the superposing process is not carried out, the output of a predetermined subfield coding circuit is selected in the superposing circuit.

In contrast to this, it may be possible to carry out the superposing process during a normal state and not to do so when the detected amount of movement is equal to or larger than a predetermined amount of movement, that is, in the case of a very fast moving image, because the superposing process has no effect. This can be applied to a case where the superposing process is carried out when the above-mentioned detected amount of movement is equal to or larger than the first amount of movement and in this case, the superposing process is carried out when the detected amount of movement is between the first amount of movement and a second amount of movement, which is larger than the first amount of movement, and the superposing process is not carried out in other cases.

Further, it may be possible not to carry out the superposing process when the amount of level is smaller than a predetermined amount of level and to do so only when the amount of level is equal to or larger than a predetermined amount of level. The judgment based on the amount of level and that based on the amount of movement may be combined. For example, it may be possible to carry out the superposing process only when the detected amount of movement is equal to or larger than the first amount of movement and the amount of level is equal to or larger than a predetermined amount of level.

Furthermore, the path switching control circuit switches the switch to the sub-path output when the amount of level is equal to or larger than a predetermined amount of level at which the moving image false contour is detected and at the same time the detected amount of movement is equal to or larger than the first amount of movement, that is, in the case of a moving image.

It may also be possible for the path switching control circuit to comprise a parameter operation circuit for calculating a parameter by carrying out a predetermined operation on the amount of level and the detected amount of movement and switch the switch to the sub-path output when the parameter is equal to or larger than a predetermined parameter value.

Still furthermore, it may also be possible to carry out the superposing process only when the detected amount of movement is between the first amount of movement and the second amount of movement, and switch the switch to the sub-path output when the detected amount of movement is equal to or larger than a third amount of movement, which is between the first and second amounts of movement, if the detected amount of movement is equal to or smaller than the first amount of movement and equal to or larger than the second amount of movement and the superposing process is not carried out.

Even when the path switching control circuit has to switch the switch to the sub-path, if the neighboring pixel has already been switched to the sub-path, it may be possible to switch so that the sub-path is not selected but the main path is selected. On account of this, it is possible to prevent the pixels to be processed in the sub-path from lining up one after another and the granular noise can be reduced.

When the superposition is controlled, the subfield coding to be used is switched from one to another for each pixel and the switching can be carried out for each of neighboring horizontal lines or vertical lines, or in a staggered order, and moreover, the selection may be changed for each field.

Further, when there are two kinds of subfield coding patterns, it may be possible to make the selection for the current two neighboring color pixels differ from that for the previous two neighboring color pixels and make the next two neighboring color pixels differ from the current two neighboring color pixels, and so on, in the transverse direction, and shifts the position of the color pixel by one for each transverse display line, and further shifts the position of the color pixel by one for each field on the display screen on which three color pixels making up the pixels are arranged.

BRIEF DESCRIPTION OF THE DRAWINGS

The features and advantages of the invention will be more clearly understood from the following description taken in conjunction with the accompanying drawings, wherein:

FIG. 4A and FIG. 4B are diagrams showing the subfield lighting pattern according to a superposing method in an embodiment;

FIG. 5A and FIG. 5B are diagrams showing the subfield lighting pattern according to a superposing method in an embodiment;

FIG. 6A and FIG. 6B are diagrams showing arrangement examples of superposing patterns;

FIG. 8A and FIG. 8B are diagrams showing arrangement examples of superposing patterns;

FIG. 9A and FIG. 9B are diagrams showing arrangement examples of superposing patterns;

FIG. 10A to FIG. 10C are diagrams showing arrangement examples of superposing patterns;

DESCRIPTION OF THE PREFERRED EMBODIMENTS

Figure 1:
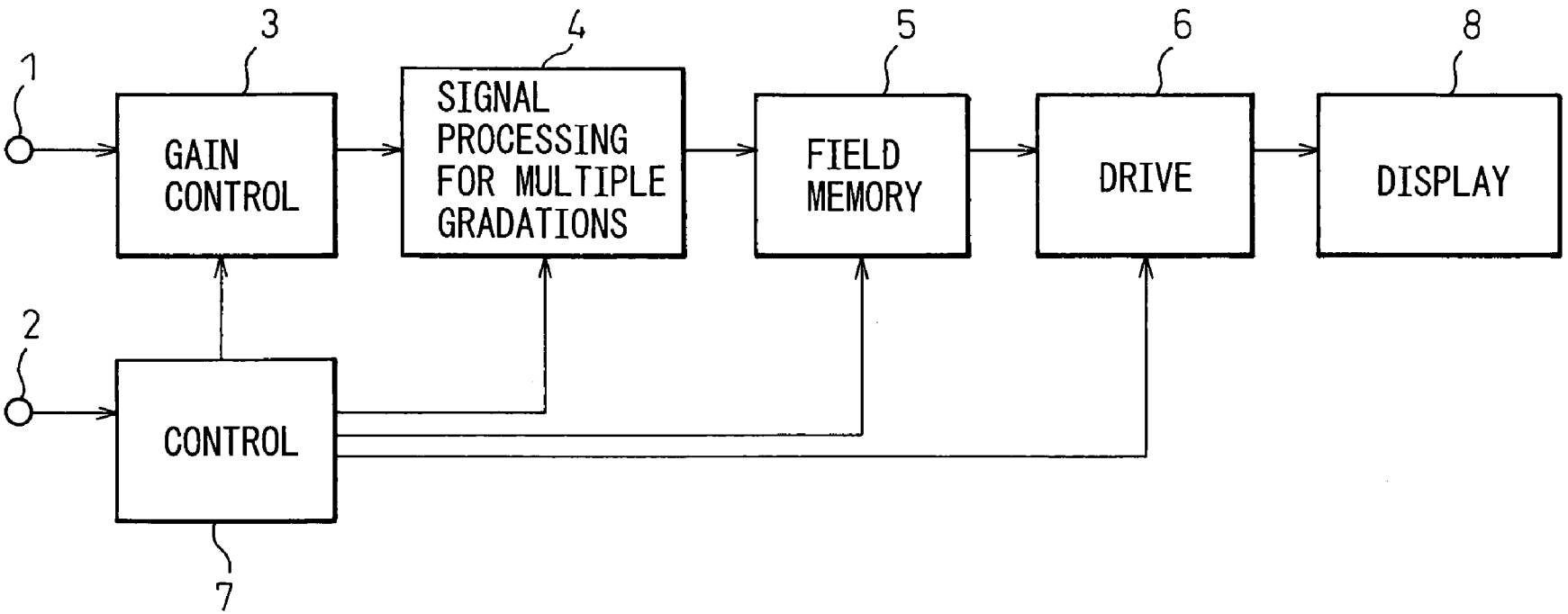
FIG. 1 is a block diagram showing the general configuration of a display device for multiple gradations in an embodiment of the present invention.

FIG. 1 is a diagram showing the general configuration of the display device for multiple gradations in the embodiment of the present invention. In FIG. 1, reference number 1 denotes an input terminal to which an image signal is input, 2 denotes an input terminal to which a synchronization signal, such as a horizontal synchronization signal (Hsync) or a vertical synchronization signal (Vsync), and a dot clock are input, 3 denotes a gain control circuit for converting an input signal with a certain number of gradations into an image signal with a predetermined number of gradations in accordance with the display device, 4 denotes a processing circuit for multiple gradations including a subfield coding function for converting an image signal with a predetermined number of gradations output from the gain control circuit into information of each subfield for each pixel, 5 denotes a subfield memory for storing the subfield information of two subfields of each pixel coded by the subfield coding function, 6 denotes a drive circuit for driving a display unit 8, 7 denotes a control circuit for outputting a control signal for controlling the operations of the processing circuit for multiple gradations 4 and the drive circuit 6 from the synchronization signal input from the input terminal 2, and 8 denotes a display unit such as a plasma display panel. The field memory 5, after storing the subfield information of one field of each pixel, outputs the information for each subfield in the next subfield.

Figure 2:
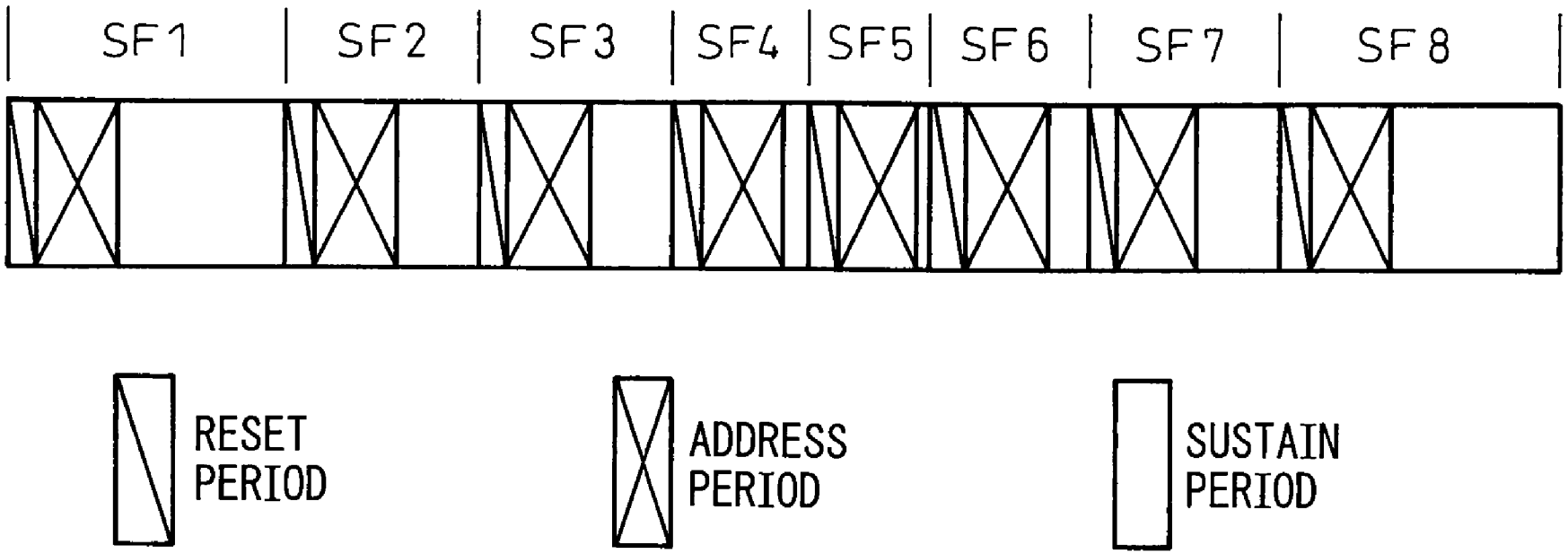
FIG. 2 is a diagram showing the subfield configuration of a display device in an embodiment.

FIG. 2 is a diagram showing the subfield configuration of the display device in the embodiment. As shown schematically, one field is made up of eight subfields SF1 to SF8 and each subfield has a reset period, an address period and a sustain period. Although the reset period and the address period are the same in length in each subfield, there may be a case where the reset period is provided only in some of subfields. The length of the sustain period determines the luminance of each subfield. In the present embodiment, the ratio of the lengths of the sustain periods of the subfields SF1 to SF8 is 16:8:8:2:1:4:8:16, that is, 64 gradations can be represented.

Figure 3:
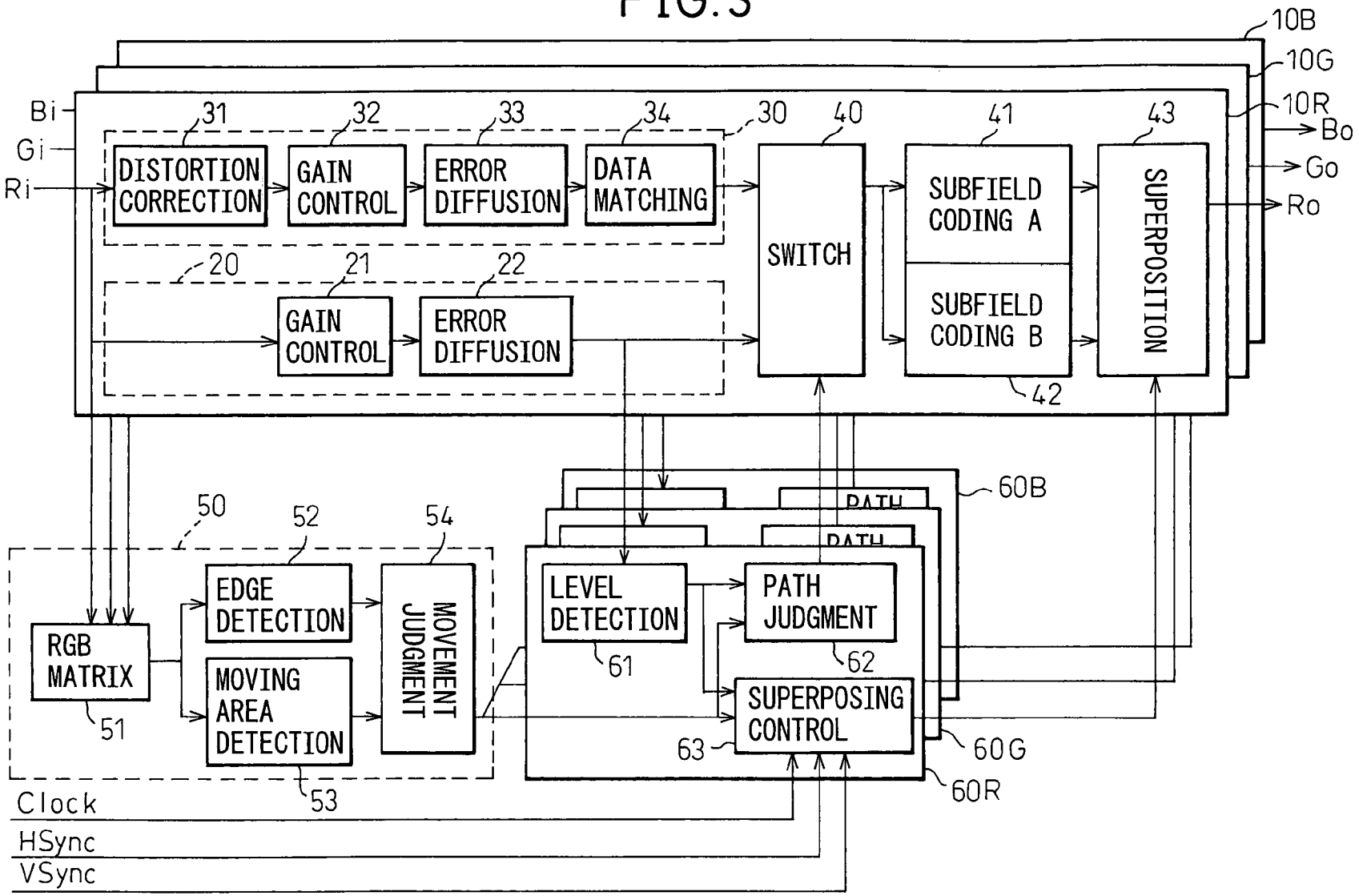
FIG. 3 is a diagram showing the configuration of a processor for multiple gradations in an embodiment.

FIG. 3 is a diagram showing the detailed configuration of the gain control circuit 3, the processing circuit for multiple gradations 4 and the control circuit 7 in FIG. 1. As shown schematically, with the exception of a movement detection section 50, identical processing circuits for multiple gradations 10R, 10G and 10B and judgment control circuits 60R, 60G and 60B are provided for the three primary colors R, G and B, and processes are carried out independently of each other for each of the three primary colors.

Each processing circuit for multiple gradations has a main path 20, a sub-path 30, a switch 40, a subfield coding A circuit 41, a subfield coding B circuit 42 and a superposing circuit 43. Input signals (Ri, Gi, Bi) are each input to the main path 20 and the sub-path 30, respectively. The main path 20 has a gain control circuit 21 and an error diffusion circuit 22. The gain control circuit 21 is a circuit for converting an input signal into a 6-bit signal in accordance with 64 gradations, the levels of which ranging from 0 to 63, which can be represented by the main path, and when an input signal is, for example, an 8-bit signal which can represent 256 gradations, it is converted into a 6-bit signal by eliminating the two least significant digits. The error diffusion circuit 22 diffuses the error due to the signal of the two eliminated least significant digits over the surrounding pixels in order to reduce the influence due to the elimination of the two digits, thereby an impression as if the number of gradations which can be represented were increased can be obtained. Although the number of gradations which can be represented by the main path is 64, which is the maximum number of gradations represented by six bits, in the above-mentioned description, the number of gradations does not necessarily need to be the maximum number of gradations represented by a given number of bits and if, for example, the number of gradations which can be represented by the main path is 73, the gain control circuit 21 converts 256 gradations into 73 gradations and the error diffusion circuit 22 carries out a process for diffusing the error due to the gradations of 256 gradations not in accordance with the 73 gradations over the surrounding pixels.

The sub-path 30 has a distortion correction circuit 31, a gain control circuit 32, an error diffusion circuit 33 and a data matching circuit 34. In the process by the sub-path 30, only nine gradations of levels 0, 1, 3, 7, 15, 23, 31, 47 and 63 can be represented from among 64 gradations of levels 0 to 63 which can be represented in the process by the main path. First, therefore, the distortion of an input signal accompanying conversion is corrected in the distortion correction circuit 31. Consequently to this, the signal is converted into a corresponding gradation level in the gain control circuit 32. In this circuit, a signal whose level is one of 256 gradations, that is, 0 to 255, is converted into a signal with a discrete level among 9 gradations, that is, levels 0, 1, 3, 7, 15, 23, 31, 47 and 63. The error diffusion circuit 33 carries out a process for diffusing the errors due to the levels other than the gradation levels which can be represented by the sub-path over the surrounding pixels. The data matching circuit 34 carries out a process for matching the luminance level in the sub-path with that in the main path.

The switch 40 normally selects and outputs the output of the main path 20, but also selects and outputs one of the outputs of the sub-path 30 in accordance with the path selection signal from the corresponding judgment control circuit.

The subfield coding A circuit 41 and the subfield coding B circuit 42 store subfield coding tables A and B, respectively, which store different subfield lighting patterns, as shown in FIG. 4A, FIG. 4B, FIG. 5A and FIG. 5B, and output 8-bit subfield lighting information in accordance with the gradation level of the signal output from the switch 40. For example, when the gradation level is 36, the subfield coding A circuit 41 outputs the 8-bit subfield lighting information such as 1, 1, 1, 0, 0, 0, 1, 0 (1 denotes a lit state, 0 an unlit state) in accordance with SF1 to SF8, and the subfield coding B circuit 42 outputs the subfield lighting information such as 0, 1, 0, 0, 0, 1, 1, 1.

A signal from the main path 20 can select any one of the gradation levels from 0 to 63, but the gradation levels which can be represented by a signal from the sub-path 30 are only nine gradation levels, that is, 0, 1, 3, 7, 15, 23, 31, 47 and 63, and these levels are characterized in that all of the subfields to be lit are successive. Because of this, a signal from the sub-path 30 will not cause the moving false contour.

Further, in the subfield configuration in the present embodiment, there are provided three subfields with luminance ratio eight and two subfields with luminance ratio 16, and it is possible for there to be multiple combinations for representing one gradation level equal to or higher than gradation level eight. As shown in FIG. 4A to FIG. 5B, in the subfield coding tables A and B stored by the subfield coding A circuit 41 and the subfield coding B circuit 42, the positions of the subfields to be lit are arranged so as to be symmetric between the first half set of subfields SF1 to SF4 and the second half set of subfields SF5 to SF8 when gradation level is eight or higher.

Furthermore, as shown in FIG. 4A to FIG. 5B, the amount of level L, which indicates the tendency for the moving image false contour to appear, is assigned to each gradation. Here, the amount of level L of a gradation is set to two when there is carrying to a subfield whose weight (luminance ratio) is 4, set to three when there is carrying to a subfield whose weight is 8, and set to four when there is carrying to a subfield whose weight is 16.

In the present embodiment, as shown in FIG. 6A, the coding is carried out for each line in the transverse direction in the display screen by the use of the subfield coding table A and the subfield coding table B. On account of this, the moving false contour is prevented because the positions of the subfields to be lit in a field are averaged between the vertically adjacent lines.

The superposing circuit 43 selects and outputs the subfield lighting information output from the subfield coding A circuit 41 and the subfield coding B circuit 42 for each pixel in accordance with the superposing control signal from the corresponding judgment control circuit. The 8-bit subfield lighting information output from the superposing circuit 43 is inputted in the field memory 5 shown in FIG. 1. Regardless of the arrangement shown in FIG. 6A, the superposing circuit 43 normally selects the subfield lighting information output from the subfield coding A circuit 41 and alternately selects the subfield lighting information output from the subfield coding A circuit 41 and that output from the subfield coding B circuit 42 in accordance with the arrangement shown in FIG. 6A only when the superposing control signal is input.

The movement detection circuit 50 has an RGB matrix circuit 51 for calculating a luminance signal from the three R, G and B primary color signals, an edge detection circuit 52 for detecting an edge from the change of the luminance signal, a moving area detection circuit 53 for detecting the amount of movement from the change of the luminance signal, and a movement judgment circuit 54 for judging whether the image is a static one or a moving one for each pixel from the detected edge and amount of movement and outputting the amount of movement M in the case of the moving image.

Each judgment control circuit has a level detection circuit 61 for detecting and outputting the amount of level L for each pixel from the output of the error diffusion circuit 22 in the main path 20, a path judgment circuit 62 for outputting a path selection signal for switching the switch 40 so that the output of the sub-path 30 is selected based on the amount of movement M and the amount of level L, and a superposing control circuit 63 for outputting a superposition selection signal for controlling to select either of the output of the subfield coding A circuit 41 and the output of the subfield coding B circuit in the superposing circuit 43 based on the amount of movement M and the amount of level L.

Figure 7:
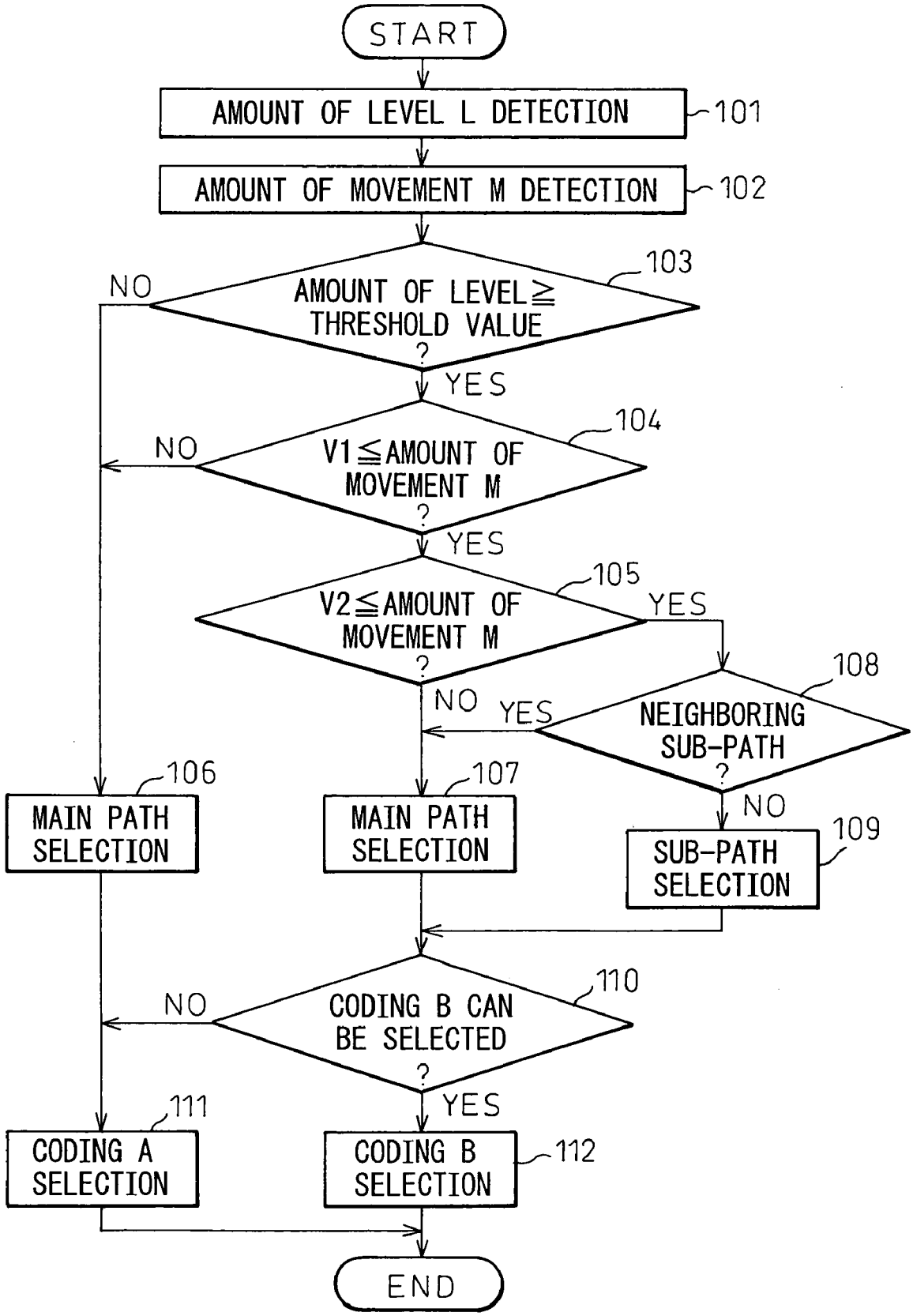
FIG. 7 is a flow chart showing the control process in an embodiment.

FIG. 7 is a flow chart showing the process in the movement detection circuit 50 and each judgment control circuit. In step 101, the level detection circuit 61 detects for each pixel the amount of level L indicating the tendency for the moving image false contour to appear. In step 102, the movement detection circuit 50 detects the amount of movement M. In step 103, whether L is larger than the threshold value is judged. If the amount of level L is smaller than the threshold value, no process is required to prevent the occurrence of the moving false contour, therefore, the next step will be step 106. If the amount of level L is larger than the threshold value, whether the amount of movement M is larger than a first movement threshold value V1 is judged in step 104. If M is smaller than V1, no process is required to prevent the occurrence of the moving false contour, therefore, the next step will similarly be step 106. In step 106, the main path 20 is selected and further in step 111, the output of the subfield coding A circuit 41 is selected.

When M is larger than V1, whether the amount of movement M is larger than a second movement threshold value V2, which is larger than V1, is further judged in step 105. When M is smaller than V2, the movement is slow and the moving false contour can be prevented only by carrying out the superposing process, therefore, the next step is 107, where the main path 20 is selected and then whether the subfield coding table B can be selected is judged in step 110. This is applicable only to a case where one of the subfield coding tables A and B can be selected for each pixel in a field, and when the superposing process is carried out but the subfield coding table B cannot be selected, the output of the subfield coding A circuit 41 is selected in step 111. When the subfield coding table B can be selected, the output of the subfield coding B circuit 42 is selected in step 112.

When M is larger than V2, the movement is fast and it is desirable to carry out the process by the sub-path 30. Therefore, in step 108, whether the pixel adjacent to the pixel in question has already selected the sub-path 30 is judged. When the adjacent pixel has already selected the sub-path 30, noise will become conspicuous because pixels for the sub-path process line up one after another, therefore, the sub-path is not selected and step 110 is selected as the next step. When the adjacent pixel has not selected the sub-path 30 yet, the sub-path is selected in step 109 and step 110 is selected as the next step. As described above, whether the subfield coding table B can be selected is judged in step 110 and when the subfield coding table B cannot be selected, the output of the subfield coding A circuit 41 is selected in step 111, and when the subfield coding table B can be selected, the output of the subfield coding B circuit is selected in step 112.

In this process, as described above, when the amount of level L is larger than the threshold value and the amount of movement M is between the first and second movement threshold values V1 and V2, the superposing process in which the output of the subfield coding A circuit 41 and the output of the subfield coding B circuit 42 are selected alternately is carried out, but the switching of path for selecting the sub-path is not carried out. When the amount of level L is larger than the threshold value and the amount of movement M is equal to or larger than the second movement threshold value V2, the superposing process and the switching of path are carried out simultaneously. In other cases, the output of the subfield coding A circuit 41 is selected and the main path is selected. In other words, neither of the superposing process and the switching of path is carried out. However, in the case where the superposing process and the switching of path are carried out, it should be considered whether such processes can be carried out with the position of the pixel in question and the relation to neighboring pixels being into account. In other words, when the amount of level is one at which a moving image false contour is likely to occur and the image is a moving one, the superposing process is carried out and when the amount of level is such one at which a moving image false contour is likely to occur and the image is a fast moving one, the superposing process and the switching of path are carried out simultaneously.

Due to the above-mentioned processes, the shock caused by the switching of the path is cushioned and an effect can be expected when the image is a fast moving one and a moving image false contour occurs in a larger area. The false contour is less conspicuous when it occurs sparsely in a peripheral area than when it occurs densely in a small area. By alternately selecting the main path and the sub-path for every two pixels, the false contour is unlikely to be recognized as a false contour even if it occurs because it occurs sparsely in a large area.

A moving false contour occurs only at a part of a gradation of an image including several specific gradations at which a false contour is likely to occur. Therefore, by carrying out the process as shown in the present embodiment, a moving false contour can be prevented from occurring.

Although the control process in the present embodiment is explained above, various modifications are possible. Some of them are explained below.

Figure 11:
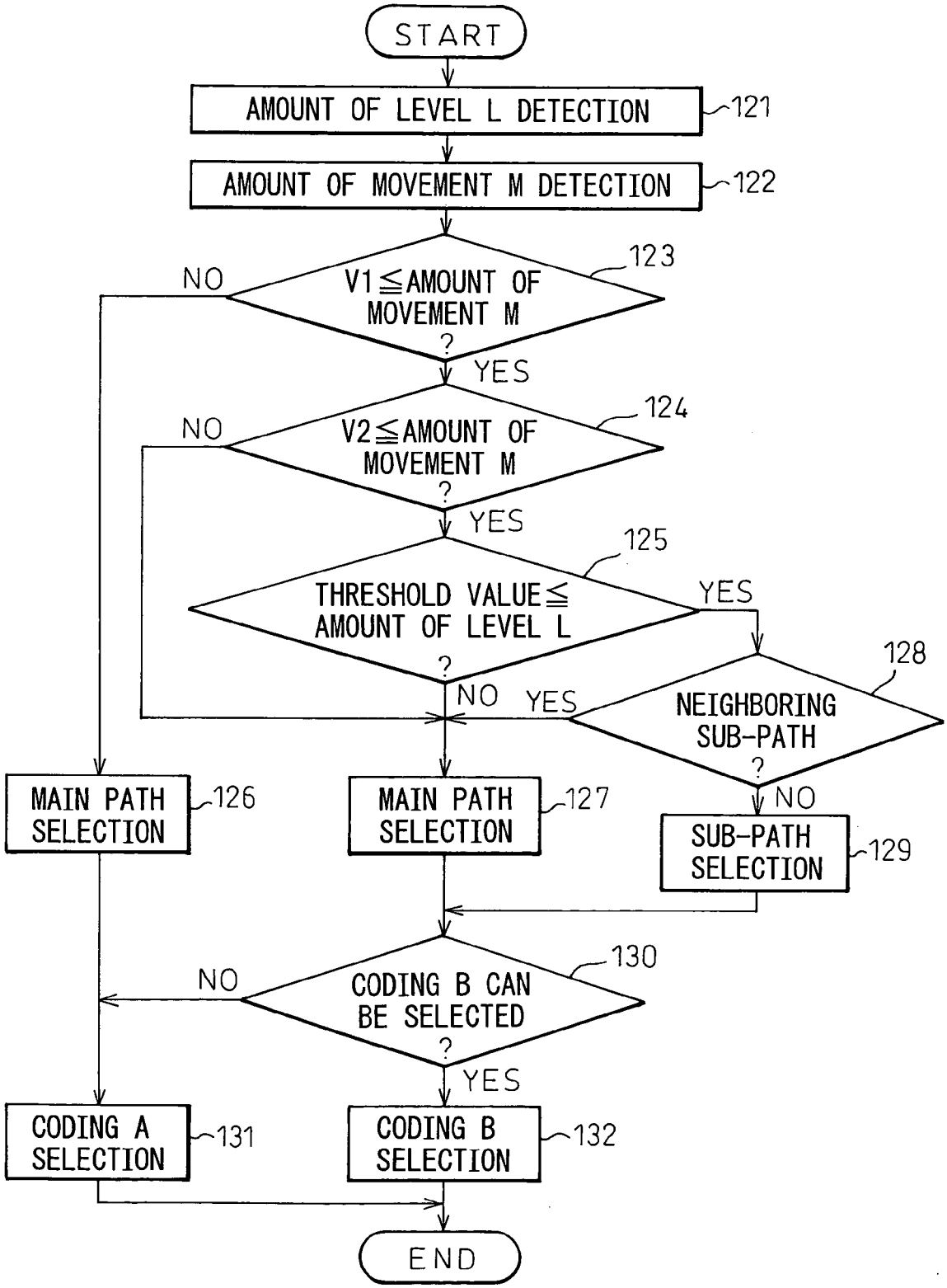
FIG. 11 is a flow chart showing another control process in an embodiment.

FIG. 11 is a flow chart showing another process in the movement detection circuit 50 and each judgment circuit. The processes in steps 121 and 122 and steps 126 to 132 are the same as those in steps 101 and 102 and steps 106 to 112 in FIG. 7, and the processes in steps 123 and 104 are the same, the processes in steps 124 and 105 are the same, and the processes in steps 125 and 103 are the same.

In the above-mentioned processes, as shown in FIG. 11, in step 123, whether the amount of movement M is larger than V1 is judged and when the amount of movement M is smaller than V1, the next step will be step 126 and when the amount of movement M is larger than V1, the next step will be step 124. In step 124, whether the amount of movement M is larger than V2 is judged and when the amount of movement M is smaller than V2, the next step will be step 127 and when the amount of movement M is larger than V2, the next step will be step 125. In step 125, whether the amount of level L is larger than the threshold value is judged and when L is smaller than the threshold value, the next step will be step 127 and when L is larger than the threshold value, the next step will be step 128. The subsequent processes are the same as those in FIG. 7.

In the processes in FIG. 11, as described above, the superposing process is carried out regardless of the amount of level as long as the image is a moving one. The switching of path to the sub-path is carried out when the amount of movement M is larger than the second threshold value V2, that is, when the image is a very fast moving one and the gradation is such one at which a moving image false contour is likely to occur because the amount of level L is larger than the threshold value.

Figure 12:
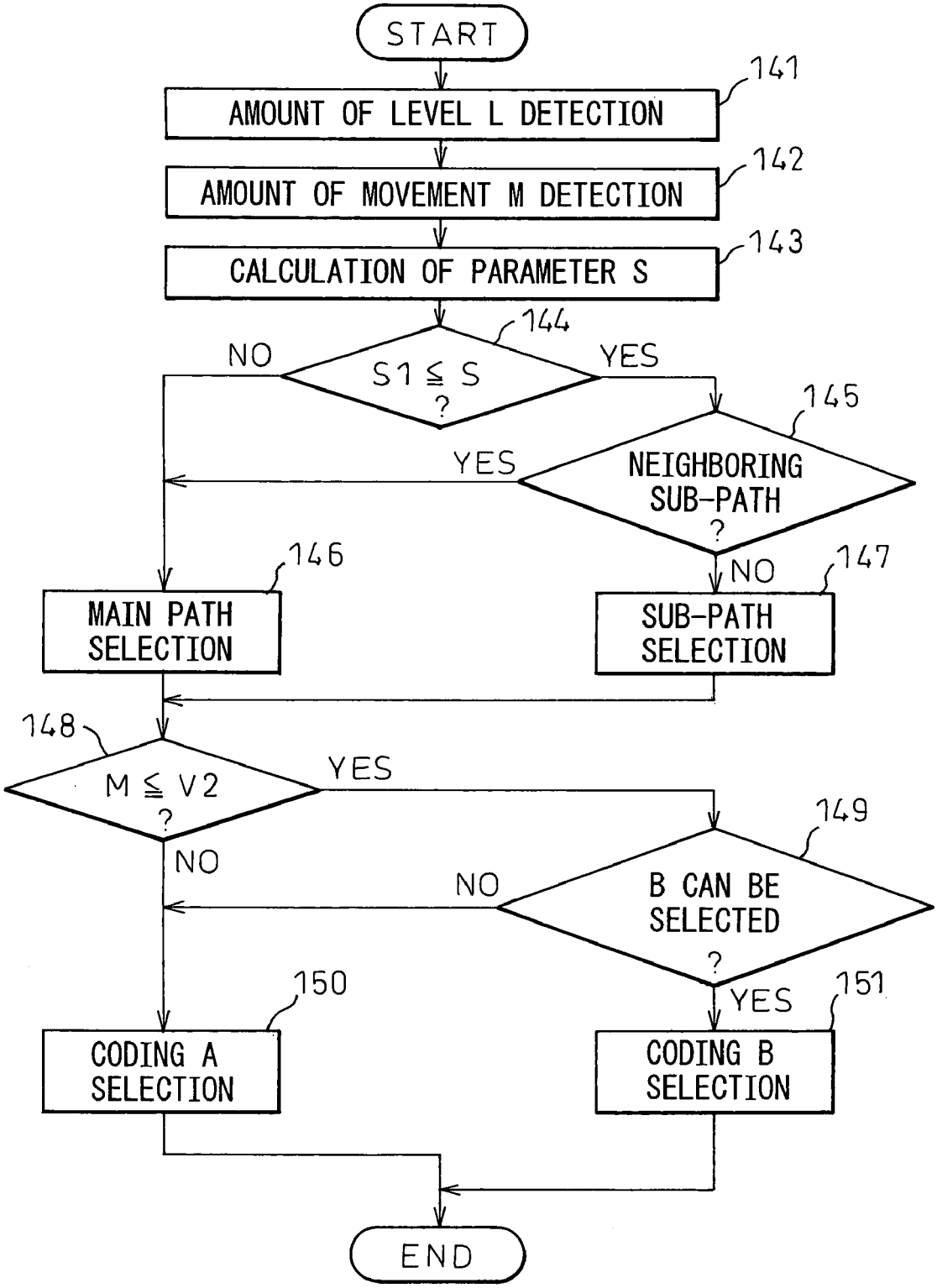
FIG. 12 is a flow chart showing another control process in an embodiment.

FIG. 12 is a flow chart further showing another process in the movement detection circuit 50 and each judgment circuit. The processes in steps 141, 142, 150 and 151 are the same as those in steps 101, 102, 111 and 112 in FIG. 7. Here, the superposition of the subfields A and B are carried out when the amount of movement M is smaller than the second threshold value V2, regardless of the amount of level. The switching of path is so carried out after a parameter S is calculated by a predetermined operation on M and L that the sub-path is selected when S is larger than a threshold value S1 and the main path is selected when S is smaller than S1. The parameter S is calculated according to a formula, for example, $S=xM+yL$ (x, y are predetermined values).

In the processes described above, as shown in FIG. 12, in step 143 after step 142, the parameter S is calculated and S is compared with the threshold value S1 in step 144. When S is smaller than S1, the main path is selected in step 146 and when S is equal to or larger than S1, whether the neighboring cell has already selected the sub-path is judged in step 145. When the neighboring cell has already selected the sub-path, the main path is selected in step 146 and when the neighboring cell has not selected the sub-path yet, the sub-path is selected in step 147. In either case, whether the amount of movement M is smaller than the threshold value V2 is judged in step 148 and when M is larger than V2, the output of the subfield coding A circuit 41 is selected in step 150. When M is smaller than V2, whether the subfield coding table B can be selected is judged in step 149 and when the subfield coding table B can be selected, the output of the subfield coding B circuit 42 is selected in step 151.

In the processes in FIG. 12, judgment on whether the superposing process is carried out is made depending on only the amount of movement M, regardless of the amount of level L but in contrast to the processes in FIG. 11, the superposing process is not carried out when the amount of movement M is larger than the second threshold value V2 because no effect can be expected. The switching to the sub-path is carried out when the parameter S, which has been obtained with the amount of movement M and the amount of level L being taken into consideration, is larger than the threshold value S1.

Figure 13:
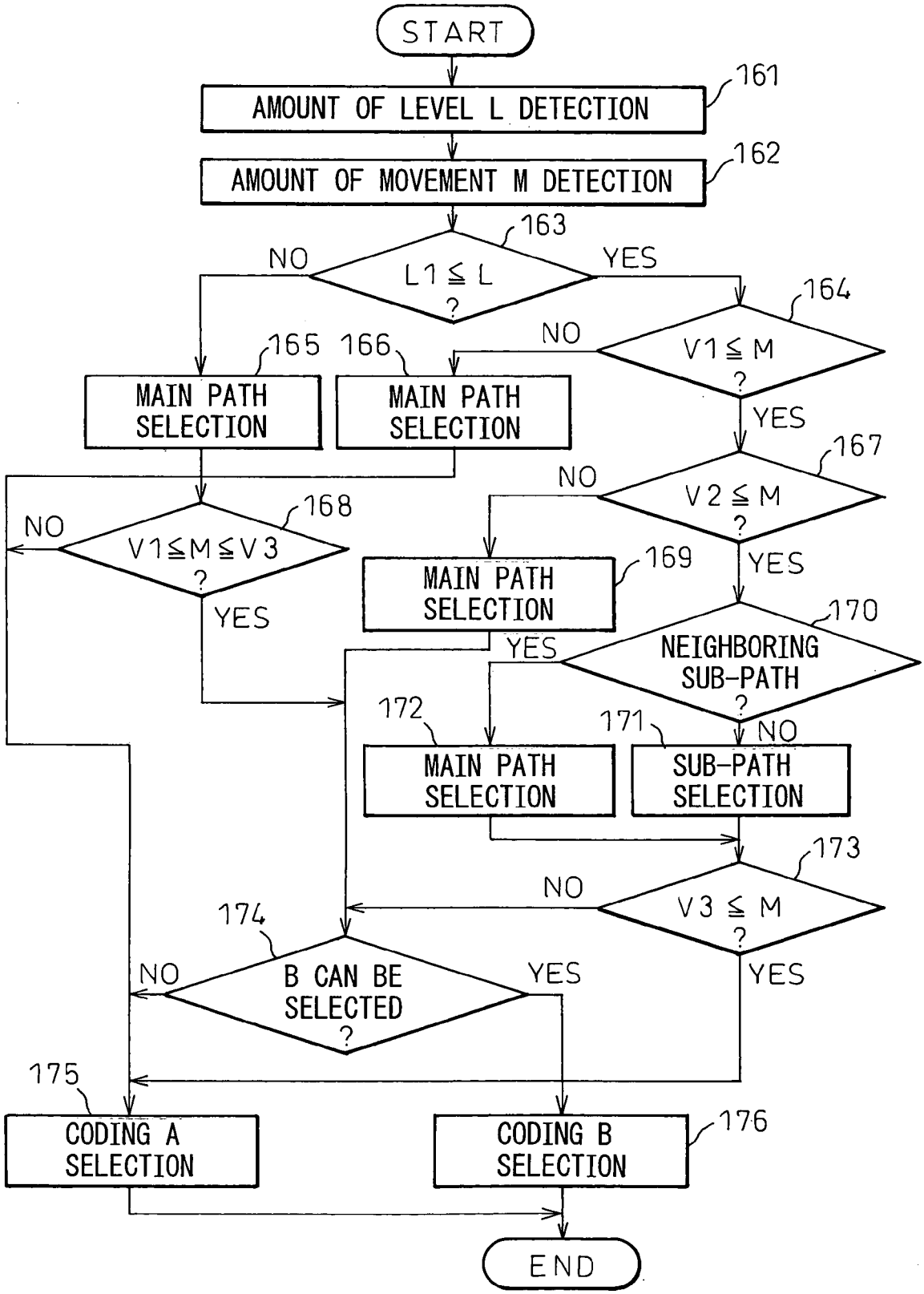
FIG. 13 is a flow chart showing another control process in an embodiment.

FIG. 13 is a flow chart further showing another process in the movement detection circuit 50 and each judgment circuit. The processes in steps 161, 162, 175 and 176 are the same as those in steps 101, 102, 111 and 112 in FIG. 7. Here, three threshold values, that is, V1, V2 and V3, are set for the amount of movement, and one threshold value, that is, L1, is set for the amount of level. The superposition of the subfields A and B is carried out when the amount of movement M is between the first threshold value V1 and the third threshold value V3, regardless of the amount of level L. The switching to the sub-path is not carried out when the amount of level L is smaller than the threshold value L1 but carried out when L is larger than L1 and the amount of movement M is larger than the second threshold value V2.

In the processes described above, as shown in FIG. 13, in step 163 after step 162, whether the amount of level L is larger than the threshold value L1 is judged. When L is smaller than L1, the main path is selected in step 165 and further in step 168, whether the amount of movement M is between the first threshold value V1 and the third threshold value V3 is judged. When M is not in this range, that is, when M is smaller than V1 or larger than V3, the output of the subfield coding A circuit 41 is selected in step 175 and when M is in this range, that is, when M is larger than V1 and smaller than V3, whether the subfield coding table B can be selected is judged in step 174 and when the subfield coding table B can be selected, the output of the subfield coding B circuit 42 is selected in step 176 and when the table B cannot be selected, the output of the subfield coding A circuit is selected in step 175.

When L is larger than L1, whether the amount of movement M is larger than the first threshold value V1 is judged in step 164. When M is smaller than V1, the main path is selected in step 166 and the output of the subfield coding A circuit 41 is selected in step 175. When M is larger than V1, whether the amount of movement M is larger than the second threshold value V2 is further judged in step 167. When M is smaller than V2, the main step is selected in step 169 and whether the subfield coding table B can be selected is judged in step 174. The subsequent processes are the same.

When M is larger than V2, whether the neighboring cell has already selected the sub-path is judged in step 170 and when the neighboring cell has not selected the sub-path yet, the sub-path is selected in step 171 and when the neighboring cell has already selected the sub-path, the main path is selected in step 172. In either case, whether the amount of movement M is larger than the third threshold value V3 is judged in step 175 and when M is larger than V3, the next step will be step 175 and when M is smaller than V3, the next step will be step 174. The subsequent processes are the same.

Figure 14:
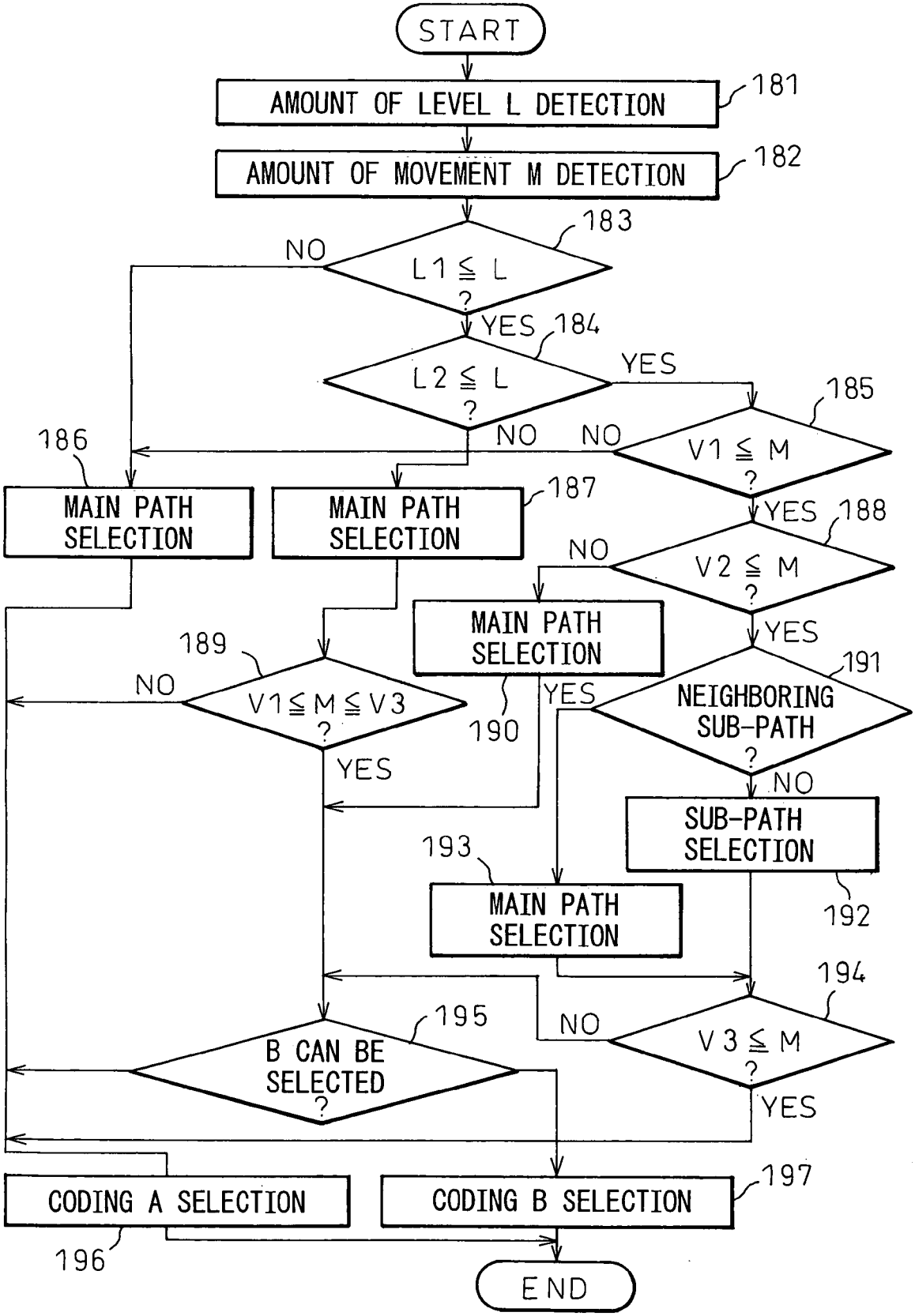
FIG. 14 is a flow chart showing another control process in an embodiment.

FIG. 14 is a flow chart further showing another process in the movement detection circuit 50 and each judgment circuit. A detailed explanation will not be given. Here, three threshold values, that is, V1, V2 and V3, are set for the amount of movement and further two threshold values, that is, L1 and L2, are set for the amount of level L. When the amount of level L is smaller than the threshold value L1, neither of the superposing process and the switching of path is carried out (the subfield of coding A is selected and the main path is selected), and when the amount of level L is larger than the first threshold value L1, the same processes as those in FIG. 13 are carried out and, here, L2 corresponds to L1. In other words, the superposition of subfields A and B is carried out while the amount of movement M is between the first threshold value V1 and the third threshold value V3 when the amount of level L is larger than L1. The switching to the sub-path is not carried out when the amount of level L is smaller than the second threshold value L2 but is carried out when L is larger than L2 and the amount of movement M is larger than the second threshold value V2.

The modifications of the control process in the present embodiment are described as above, but other modifications are also possible and parts of the processes in FIG. 7 and FIG. 11 to FIG. 14 described above can be combined. For example, it may be possible to select the subfield coding table A when the sub-path can be selected and judge whether the subfield coding table B can be selected when the sub-path cannot be selected. Moreover, it may be possible to judge whether the subfield coding table B can be selected when the amount of level L is larger than the threshold value, regardless of the amount of movement M. Still moreover, it may be possible to carry out the superposing process at all times and select the sub-path in accordance with the amount of movement M and the amount of level L.

In the present embodiment, the pixels for which the coding using the subfield coding table A and the coding using the subfield coding table B are carried out are arranged on the display screen in such a way as shown in FIG. 6A, but various modifications are possible. For example, it may be possible to alternately change the arrangement shown in FIG. 6A for each field, as shown in FIG. 6B. Moreover, it may be possible to alternately carry out the coding using the subfield coding table A and the coding using the subfield coding table B for each vertical line on the display screen, as shown in FIG. BA. It may also be possible to change the line position for each field, as shown in FIG. 8B.

Still moreover, as shown in FIG. 9A, it may be possible to alternately carry out the coding using the subfield coding table A and the coding using the subfield coding table B for each of the neighboring pixels, that is, the coding differs from another in a staggered pattern. It may also be possible to change the line position for each field, as shown in FIG. 9B.

In the embodiment described above, the superposing process is carried out independently for each pixel made up of three color image signals, but it may be possible to carry out the processes in the embodiment described above for each of the three color pixels. Moreover, as shown in FIG. 10A, it may be possible to provide two subfield coding circuits for outputting two pieces of subfield information, that is, $\alpha$ and $\beta$, and select the output of the two subfield coding circuits in such a way that $\alpha$ and $\beta$ are selected two by two alternately for the color pixels in a certain line l in a certain field f and for the color pixels in the next line l+1, the position is shifted by one color pixel and similarly $\alpha$ and $\beta$ are selected two by two alternately. Then, as shown in FIG. 10B and FIG. 10C, in the next field f+1, the position is shifted by one color pixel and selection is made, in the next field f+2, the position is further shifted by one color pixel and selection is made, and in the next field f+3, $\alpha$ and $\beta$ are selected two by two alternately from the same positions of the color pixels as those in the field f. The same selection is repeated hereafter.

The embodiment of the present invention is explained as above, but various modifications are possible for the present invention and, for example, the case where the two subfield coding circuits are provided is explained in the embodiment but it may be possible to provide three or more subfield coding circuits. Further, according to the present invention, it is possible to combine the control conditions for the path switching method and the superposing method described above in accordance with its characteristics and, thereby, an image of high quality without noise can be displayed by preventing the moving false contour in various images such as a static image, a slowly moving image and a fast moving image. Furthermore, the circuits for detecting movement and for judging whether a gradation is one that causes a moving false contour to occur are commonly used, therefore, the circuit size can be made relatively small.

As described above, according to the present invention, by combining the path switching method and the superposing method, it is possible to realize a display device capable of displaying an image of high quality without conspicuous moving false contours for various images, with a simplified configuration.

We claim:

1. A signal processor for multiple gradations for replacing one field with a plurality of subfields weighted with a predetermined luminance and coding a lit or unlit state of each display cell on a subfield basis in an input image signal having a predetermined number of gradations for each primary color, the processor comprising: a main path for generating a primary color signal having a first number of gradations from a primary color signal of an input image signal having the predetermined number of gradations, the first number of gradations being equal to or smaller than the predetermined number of gradations; a sub-path for generating a primary color signal having a second number of gradations, the second number of gradations being smaller than the first number of gradations; a switch for switching so that either of the signal generated by the main path and the signal generated by the sub-path is output; a movement detection circuit for detecting a moving area and the amount of movement by detecting the change in a primary color signal on a pixel basis between the current field and the preceding field of the input image signal; a level detection circuit for detecting and outputting the amount of level indicating the tendency for a moving image false contour to occur on a pixel basis for each primary color signal in the main path; a path switching control circuit for switching the switch from the main path output to the sub-path output based on the detected amount of movement and amount of level; plural subfield coding circuits for receiving the signal output from the switch thereto and for outputting a converted signal by carrying out different subfield coding, respectively; a superposing circuit for receiving the output of the plural subfield coding circuits thereto and selecting one of the input signals; and a superposing control circuit for controlling the selection of the output of the plural subfield coding circuits in the superposing circuit for each primary color signal on a pixel basis.

2. A signal processor for multiple gradations, as set forth in claim 1, wherein the superposing control circuits judges whether the superposing process is carried out for each primary color signal on a pixel basis is judged when the detected amount of movement is equal to or larger than a first amount of movement and when the superposing process is carried out, the selection of the plural subfield coding circuits in the superposing circuit is changed sequentially and when the superposing process is not carried out, the selection is controlled so that the output of a predetermined subfield coding circuit is selected in the superposing circuit.

3. A signal processor for multiple gradations, as set forth in claim 1, wherein the superposing control circuits judges whether the superposing process is carried out for each primary color signal on a pixel basis is judged when the detected amount of movement is equal to or smaller than a predetermined amount of movement and when the superposing process is carried out, the selection of the plural subfield coding circuits in the superposing circuit is changed sequentially and when the superposing process is not carried out, the selection is controlled so that the output of a predetermined subfield coding circuit is selected in the superposing circuit.

4. A signal processor for multiple gradations, as set forth in claim 1, wherein the superposing control circuits judges whether the superposing process is carried out for each primary color signal on a pixel basis is judged when the amount of level is equal to or larger than a predetermined amount of level and when the superposing process is carried out, the selection of the plural subfield coding circuits in the superposing circuit is changed sequentially and when the superposing process is not carried out, the selection is controlled so that the output of a predetermined subfield coding circuit is selected in the superposing circuit.

5. A signal processor for multiple gradations, as set forth in claim 1, wherein the superposing control circuits judges whether the superposing process is carried out for each primary color signal on a pixel basis is judged when the detected amount of movement is equal to or larger than a first amount of movement and, at the same time, the amount of level is equal to or larger than a predetermined amount of level and when the superposing process is carried out, the selection of the plural subfield coding circuits in the superposing circuit is changed sequentially and when the superposing process is not carried out, the selection is controlled so that the output of a predetermined subfield coding circuit is selected in the superposing circuit.

6. A signal processor for multiple gradations, as set forth in claim 2, wherein the superposing control circuit controls so that the superposing process is not carried out when the detected amount of movement is equal to or larger a second amount of movement, which is larger than the first amount of movement.

7. A signal processor for multiple gradations, as set forth in claim 1, wherein the path switching control circuit switches the switch to the sub-path output when the amount of level is equal to or larger than a predetermined amount of level and, at the same time, the detected amount of movement is larger than a first amount of movement.

8. A signal processor for multiple gradations, as set forth in claim 2, wherein the path switching control circuit switches the switch to the sub-path output when the amount of level is equal to or larger than the predetermined amount of level and at the same time the detected amount of movement is equal to or larger than a second amount of movement, which is larger than the first amount of movement.

9. A signal processor for multiple gradations, as set forth in claim 3, wherein the path switching control circuit switches the switch to the sub-path output when the amount of level is equal to or larger than the predetermined amount of level and at the same time the detected amount of movement is equal to or larger than a third amount of movement, which is between the first amount of movement and the second amount of movement.

10. A signal processor for multiple gradations, as set forth in claim 1, wherein the path switching control circuit comprises a parameter operation circuit for calculating a parameter by performing a predetermined operation on the amount of level and the detected amount of movement and switches the switch to the sub-path output when the parameter is equal to or larger than a predetermined parameter value.

11. A signal processor for multiple gradations, as set forth in claim 1, wherein the path switching control circuit switches the switch so that the main path is selected even when the path switching control circuit is bound to switch the switch to the sub-path output, if the neighboring pixel has already selected the sub-path.

12. A signal processor for multiple gradations, as set forth in claim 1, wherein the superposing control circuit makes the selection of the plural subfield coding circuits in the superposing circuit for each primary color signal differ one from another, sequentially, for each of neighboring transverse lines on the display screen.

13. A signal processor for multiple gradations, as set forth in claim 1, wherein the superposing control circuit makes the selection of the plural subfield coding circuits in the superposing circuit for each primary color signal differ, sequentially, for each of neighboring longitudinal lines on the display screen.

14. A signal processor for multiple gradations, as set forth in claim 1, wherein the superposing control circuit makes the selection of the plural subfield coding circuits in the superposing circuit for each primary color signal differ for each of neighboring transverse and longitudinal lines, that is, in a staggered pattern, on the display screen.

15. A signal processor for multiple gradations, as set forth in claim 12, wherein the superposing control circuit makes the selection of the plural subfield coding circuits in the superposing circuit for each primary color signal differ further for each of field.

16. A signal processor for multiple gradations, as set forth in claim 1, wherein there are comprised two sets of the plural subfield coding circuits, and wherein the superposing control circuit makes the selection of the plural subfield coding circuits in the superposing circuit differ sequentially for each group of two transversely neighboring color pixels and controls so that the position is shifted by one color pixel for each transverse display line and further the position is shifted by one color pixel for each field on the display screen on which three color pixels making up the pixels are arranged.

* * * * *